US005791765A

United States Patent [19]

Lin

[11] Patent Number: 5,791,765

[45] Date of Patent: Aug. 11, 1998

[54] LAMP NETTING DEVICE

[76] Inventor: Mei-Lu Lin, 56, Min Sheng Street, Fengyuan, Taichung Shien, Taiwan

[21] Appl. No.: 900,817

[22] Filed: Jul. 25, 1997

[51] Int. Cl.[6] ..... F21V 21/00

[52] U.S. Cl. ..... 362/249; 362/250; 362/252; 362/391; 362/396; 362/806

[58] Field of Search ..... 362/238, 239, 362/249, 250, 252, 806, 391, 396

[56] References Cited

U.S. PATENT DOCUMENTS

| | | | |
|---|---|---|---|
| 5,601,361 | 2/1997 | Lawrence | 362/238 |
| 5,662,409 | 9/1997 | Huang | 362/349 |
| 5,669,707 | 9/1997 | Huang | 362/249 |

*Primary Examiner*—Stephen F. Husar

[57] ABSTRACT

A lamp netting device has a net, a serial decoration lamp assembly disposed on the net, and the serial decoration lamp assembly having a plurality of decoration lamps. The net has a plurality of net strings. Each of the decoration lamps has a bulb, a lamp holder receiving the bulb, a socket receiving the lamp holder, a first lug disposed on the socket, a second lug disposed on the socket, a first slot defined between the socket and the first lug, a second slot defined between the socket and the second lug, a U-shaped clamp device disposed between the first lug and the second lug, a rod disposed on the lamp holder and above the U-shaped clamp device, a bar disposed on a distal end of the rod, and a recess formed on the rod. The rod is bent toward the U-shaped clamp device.

2 Claims, 8 Drawing Sheets

LAMP NETTING DEVICE

BACKGROUND OF THE INVENTION

This invention relates to a lamp netting device, and more particularly, this invention relates to a lamp netting device which contains a plurality of decoration lamps.

A conventional lamp netting device for a Christmas tree has a serial decoration lamp assembly disposed on a fabric. However, the fabric should perforate a plurality of holes to receive the respective clamps. Furthermore, the fabric may be fall down under a strong wind while the fabric is placed outdoors.

SUMMARY OF THE INVENTION

An object of this invention is to provide a lamp netting device to position a serial decoration lamp assembly on a net so that the lamp netting device can be wound.

Another object of this invention is to provide a lamp netting device in order to position a serial decoration lamp assembly with a plurality of decoration lamps stably.

DETAILED DESCRIPTION OF THE INVENTION

Figure 1:
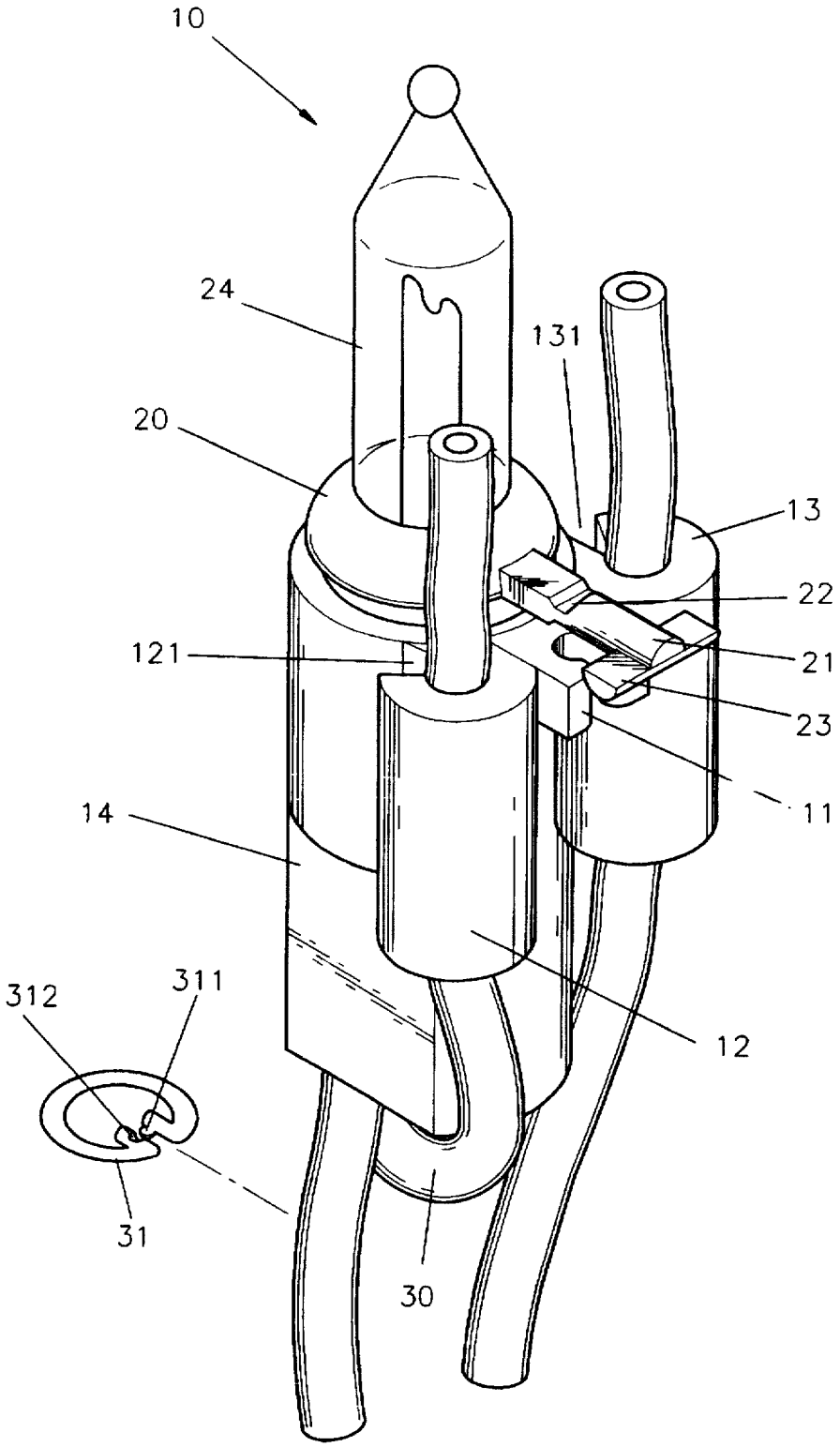
FIG. 1 is a perspective view of a decoration lamp.
Figure 2:
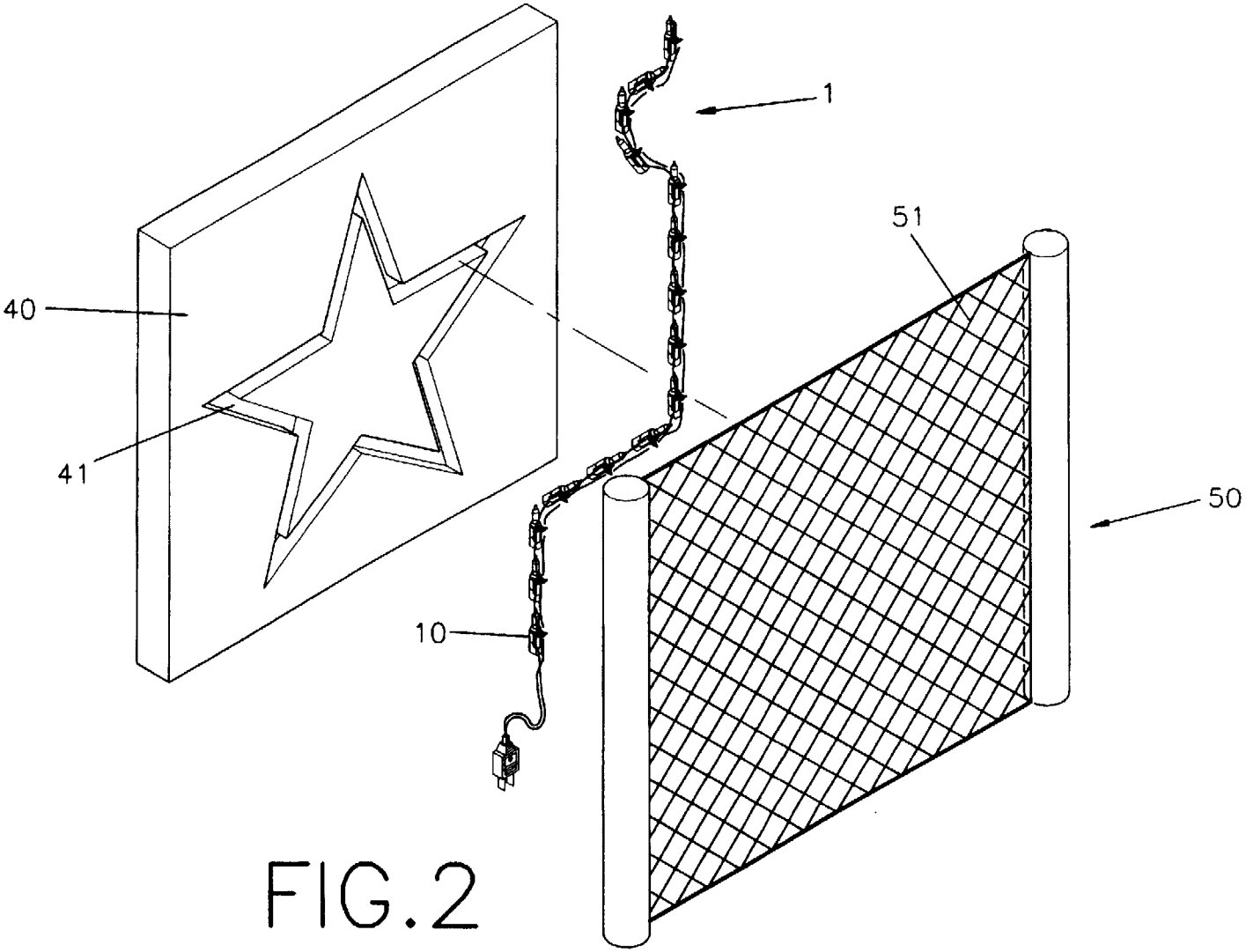
FIG. 2 is a perspective exploded view of a lamp netting device with a mold plate.
Figure 3:
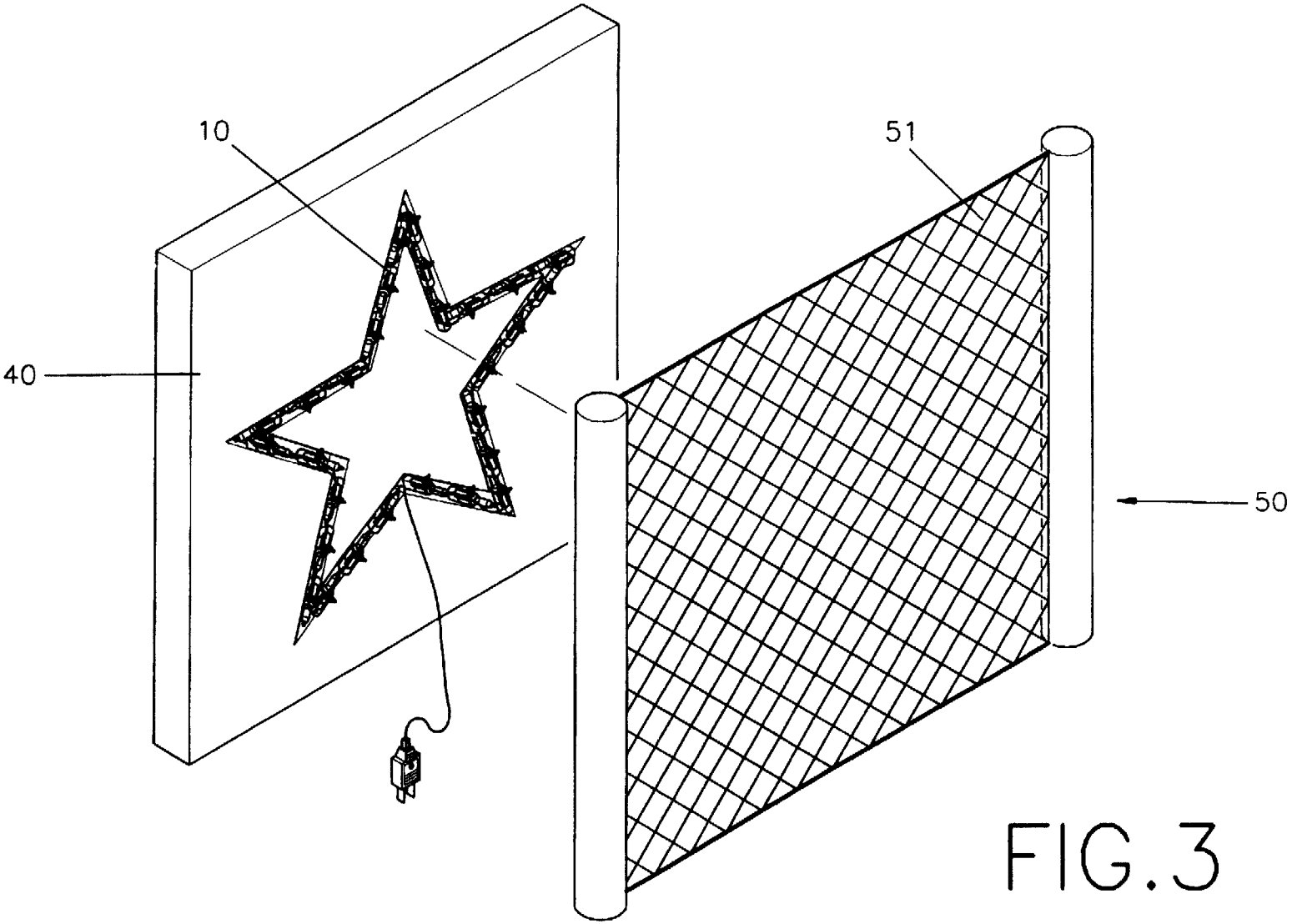
FIG. 3 is a perspective view of FIG. 2 while a decoration lamp assembly disposed on a mold plate.
Figure 4:
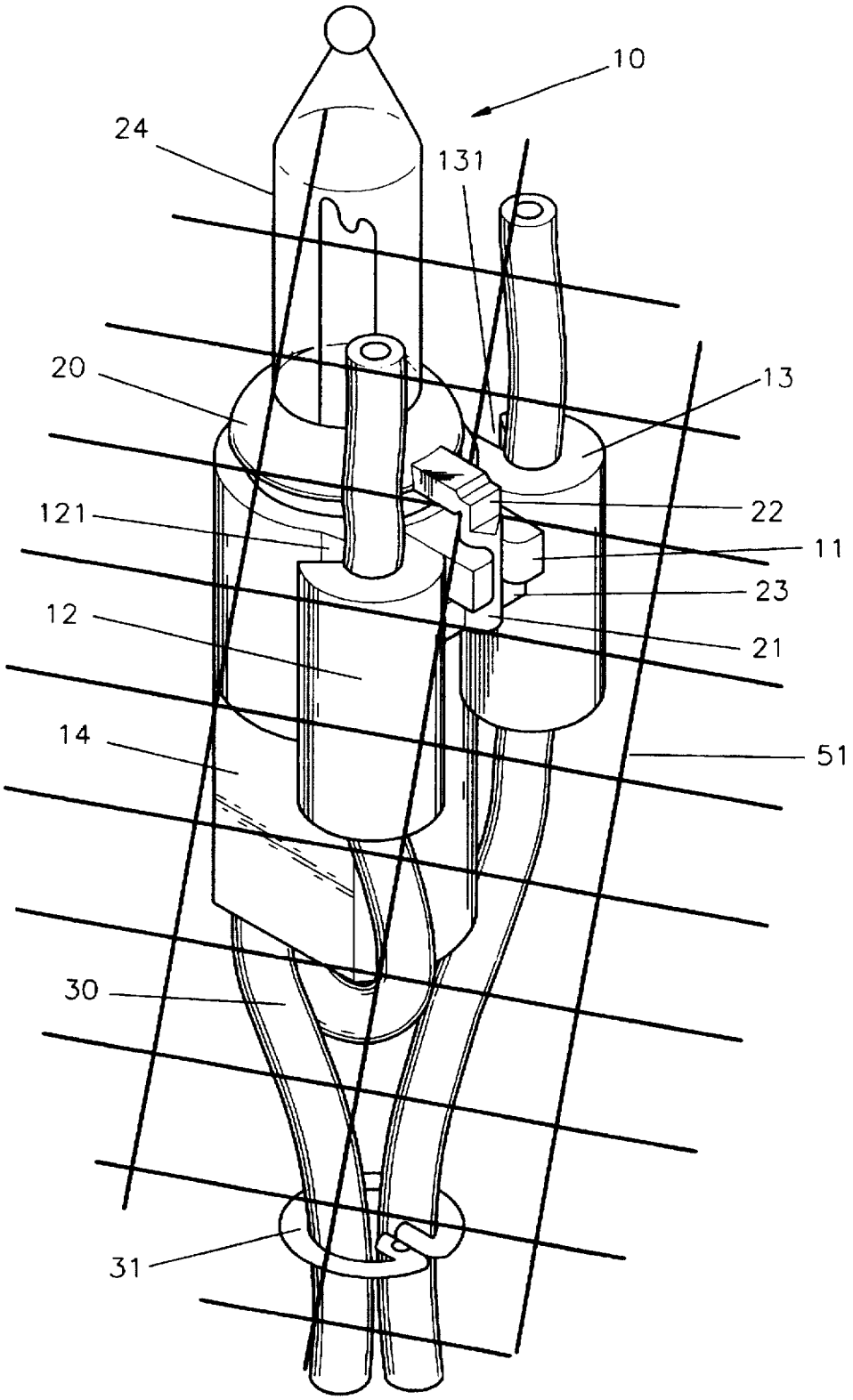
FIG. 4 is a schematic view illustrating a flexible rod clamping a net string.
Figure 5:
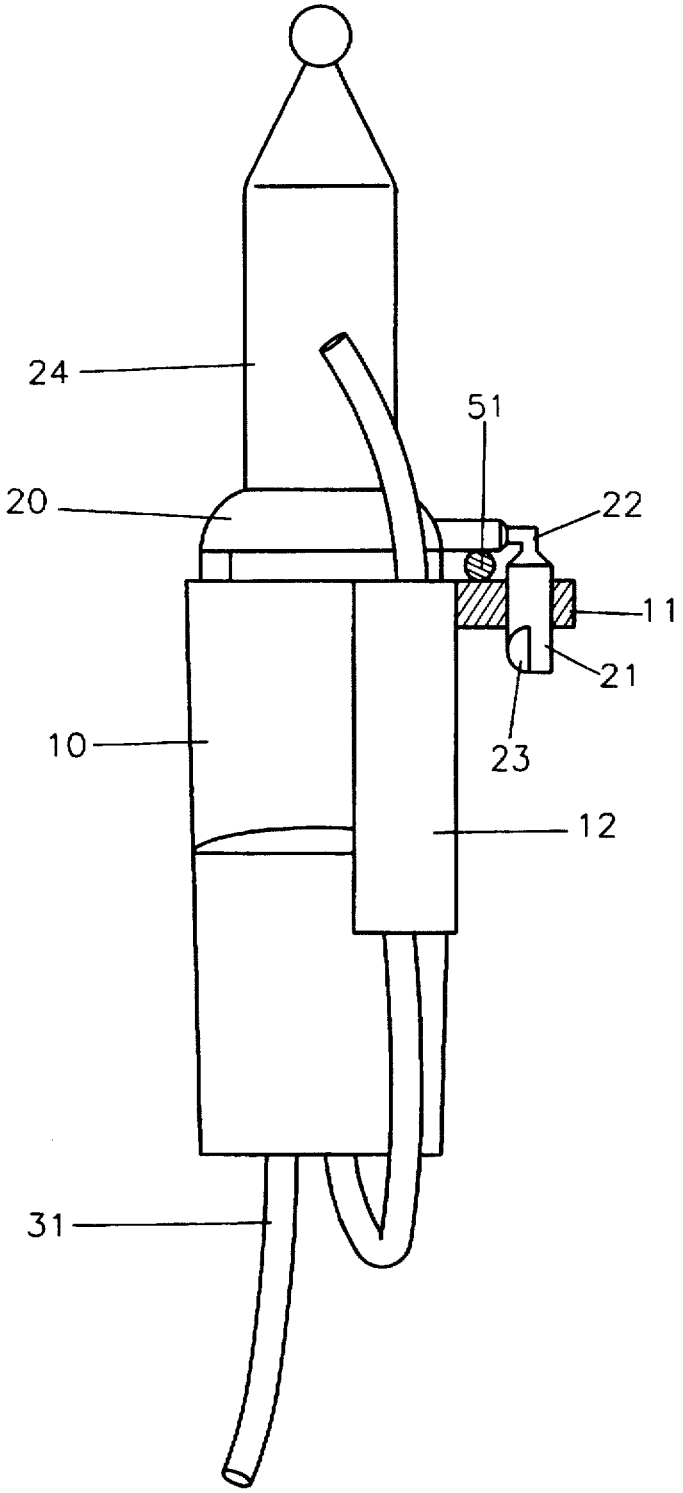
FIG. 5 is a partially sectional view illustrating a flexible rod clamping a net string.
Figure 6:
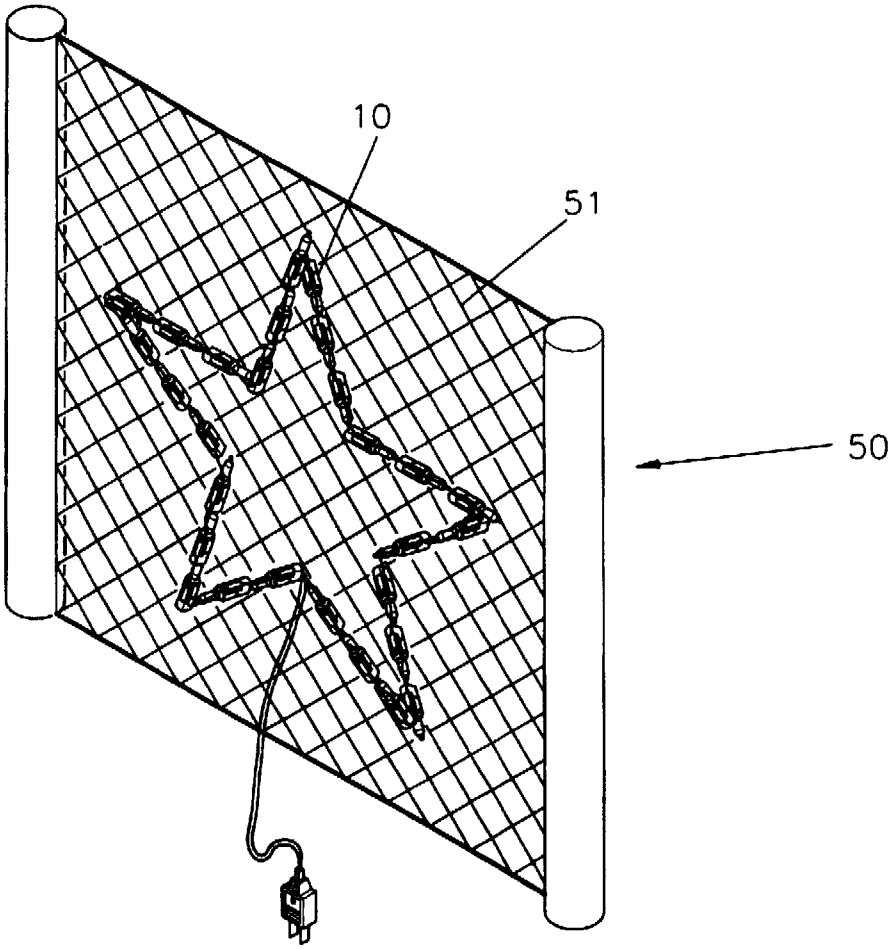
FIG. 6 is a perspective assembly view of a lamp netting device.

Referring to FIGS. 1 to 6, a lamp netting device comprises a net 50, a serial decoration lamp assembly 1 disposed on the net 50, and the serial decoration lamp assembly 1 having a plurality of decoration lamps 10. The net 50 has a plurality of net strings 51. Each of the decoration lamps 10 has a bulb 24, a lamp holder 20 receiving the bulb 24, a socket 14 receiving the lamp holder 20, a first lug 12 disposed on the socket 14, a second lug 13 disposed on the socket 14, a first slot 121 defined between the socket 14 and the first lug 12, a second slot 131 defined between the socket 14 and the second lug 13, a U-shaped clamp device 11 disposed between the first lug 12 and the second lug 13, a rod 21 disposed on the lamp holder 20 and above the U-shaped clamp device 11, a bar 23 disposed on a distal end of the rod 21, and a recess 22 formed on the rod 21 in order to bend the flexible rod 21. The rod 21 is bent toward the U-shaped clamp device 11 so that the U-shaped clamp device 11 receives a portion of the rod 21 in order to clamp the respective net string 51 between the rod 21 and the U-shaped clamp device 11. The first slot 121 receives a first wire 30. The second slot 131 receives a second wire 30. A plurality of retaining rings 31 retain the respective wires 30. The decoration lamp assembly 1 is disposed on a mold plate 40. Each of the retaining ring 31 has a protruded end 311 and a grooved end 312 engaged with the protruded end 311. The mold plate 40 has at least a pattern recess 41. The net 50 is extended on the mold plate 40. The serial decoration lamp assembly 1 is disposed on the net 50 and arranged along the pattern recess 41. Therefore, the lamp netting device can position the serial decoration lamp assembly 1 on the net 50 stably.

Figure 7:
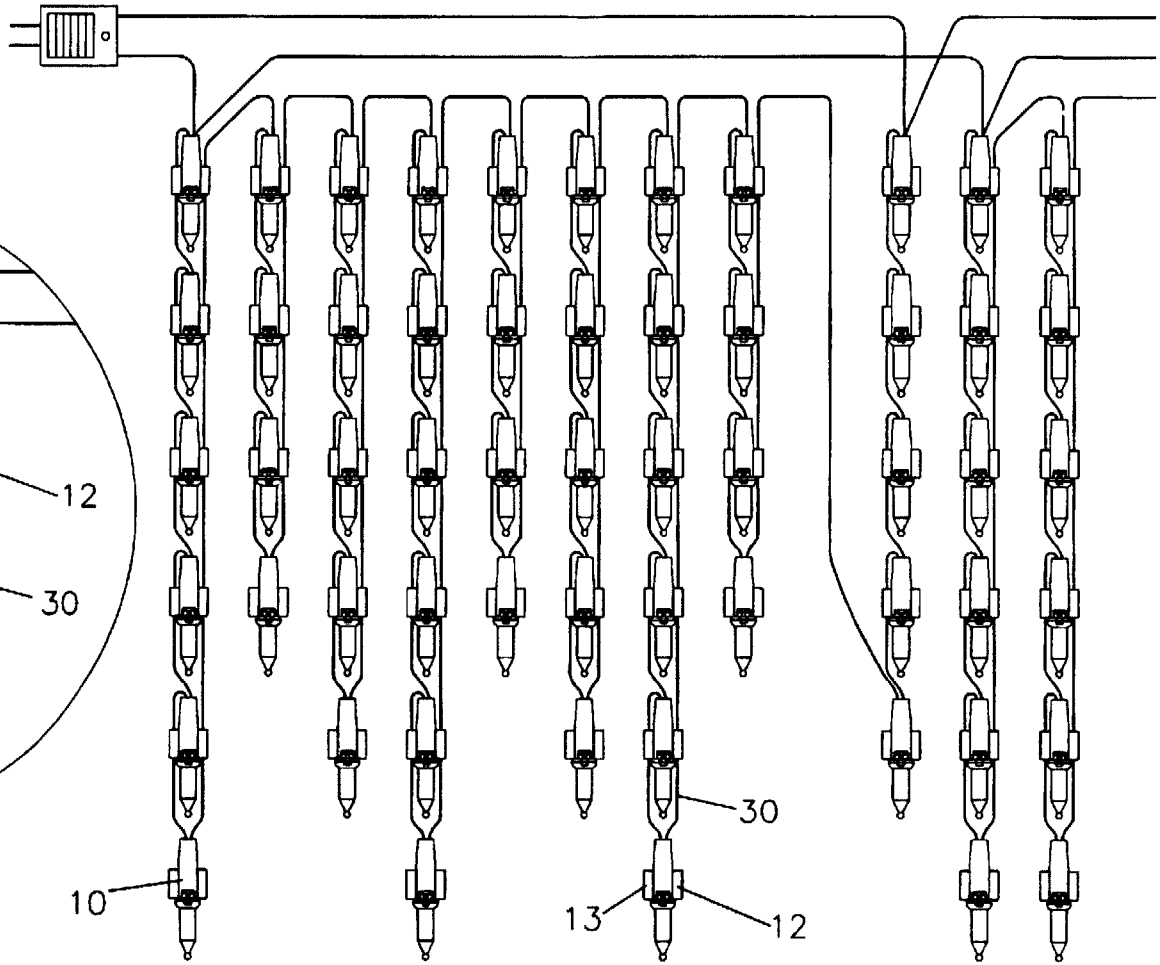
FIG. 7 is a schematic view illustrating a plurality of decoration lamps forming a second lamp assembly.
Figure 7A:
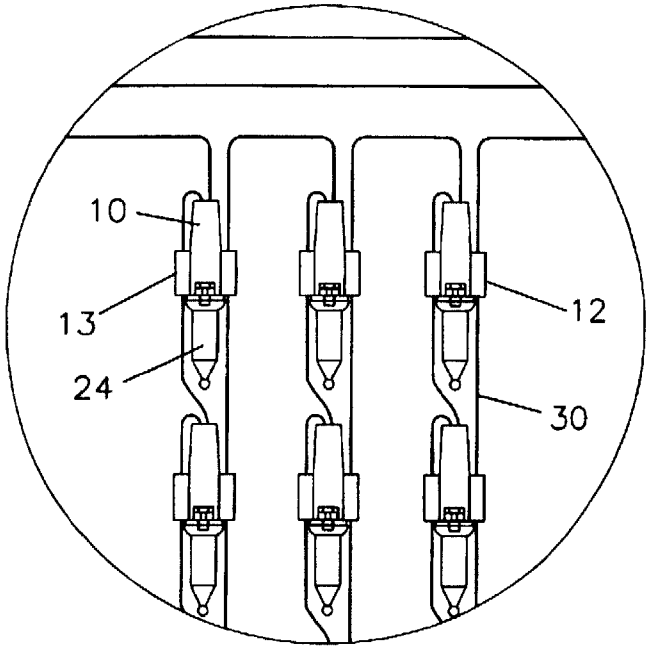
FIG. 7A is a partially enlarged view of FIG. 7.

Referring to FIGS. 7 and 7A, a second lamp assembly can arrange the wires 30 as a net. The decoration lamps 10 are arranged in series and in parallel.

Figure 8:
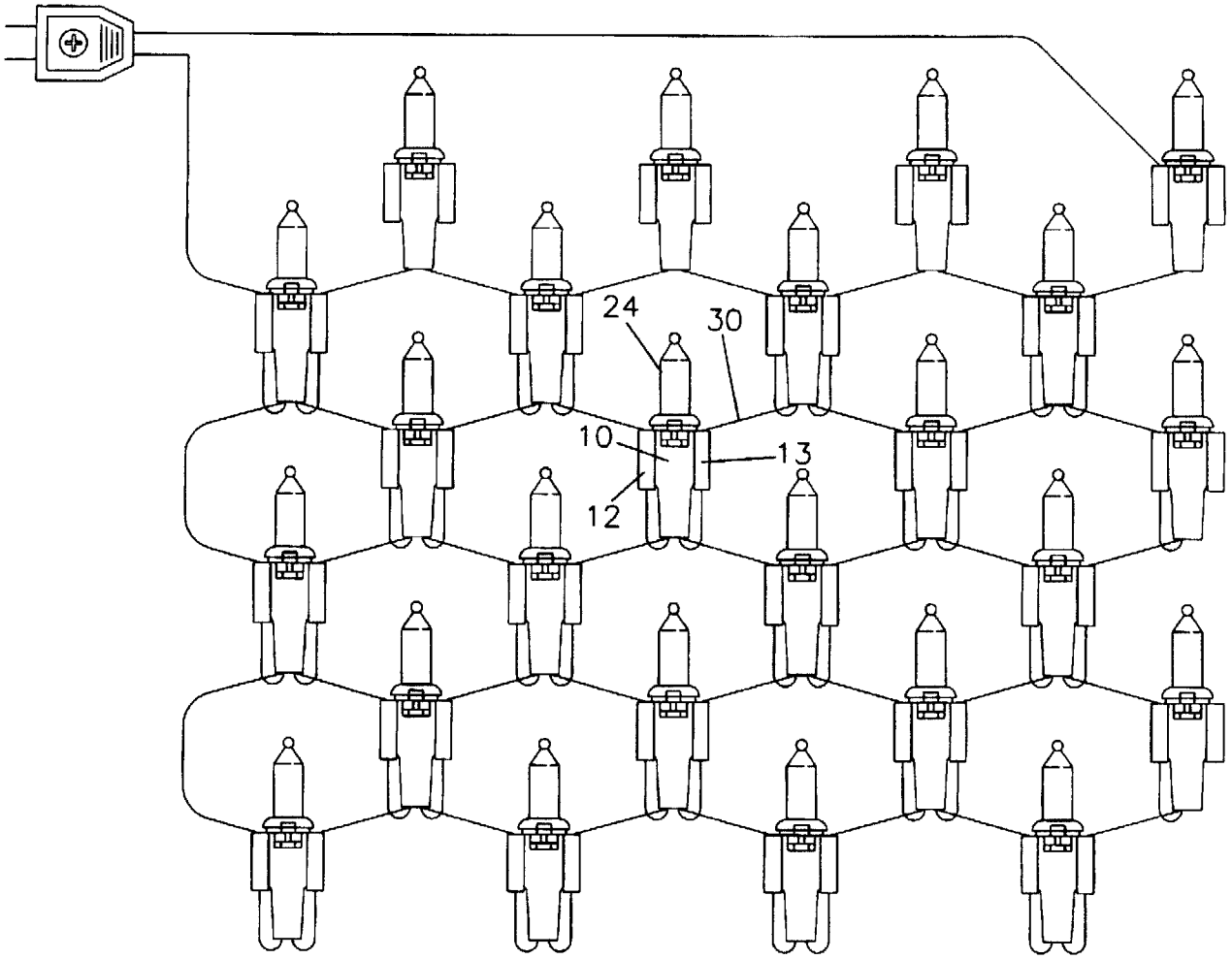
FIG. 8 is a schematic view illustrating a plurality of decoration lamps forming a third lamp assembly.

Referring to FIG. 8, a third lamp assembly can arrange the wires 30 as a net also.

Therefore, the patterns of the serial decoration lamp assembly can be varied according to the arrangement of the user. The user can use the mold plate to arrange the patterns. However, the user can arrange the patterns without the mold plate.

I claim:

1. A lamp netting device comprises:

a net, a serial decoration lamp assembly disposed on the net, the serial decoration lamp assembly having a plurality of decoration lamps, the net having a plurality of net strings, each of the decoration lamps having a bulb, a lamp holder receiving the bulb, a socket receiving the lamp holder, a first lug disposed on the socket, a second lug disposed on the socket, a first slot defined between the socket and the first lug, a second slot defined between the socket and the second lug, a U-shaped clamp device disposed between the first lug and the second lug, a rod disposed on the lamp holder and above the U-shaped clamp device, a bar disposed on a distal end of the rod, and a recess formed on the rod, wherein the rod is bent toward the U-shaped clamp device.

2. A lamp netting device as claimed in claim 1, wherein a retaining ring has a protruded end and a grooved end engaged with the protruded end.

* * * * *